US010639709B2

(12) United States Patent
Suzuki et al.

(10) Patent No.: US 10,639,709 B2
(45) **Date of Patent: *May 5, 2020**

(54) METHOD FOR A POURING CONTROL AND A STORAGE MEDIUM FOR STORING PROGRAMS FOR CAUSING A COMPUTER TO WORK AS A POURING CONTROL MEANS

(71) Applicants: Sintokogio, Ltd., Nagoya-shi, Aichi (JP); National University Corporation Toyohashi University of Technology, Toyohashi-shi, Aichi (JP)

(72) Inventors: Makio Suzuki, Toyokawa (JP); Kazuhiko Terashima, Toyohashi (JP); Atsushi Ito, Toyohashi (JP); Yoshiyuki Noda, Kofu (JP)

(73) Assignees: Sintokogio, Ltd., Aichi (JP); National University Corporation Toyohashi University of Technology, Aichi (JP)

( * ) Notice: Subject to any disclaimer, the term of this patent is extended or adjusted under 35 U.S.C. 154(b) by 106 days.

This patent is subject to a terminal disclaimer.

(21) Appl. No.: 15/917,461

(22) Filed: Mar. 9, 2018

(65) Prior Publication Data

US 2018/0193907 A1 Jul. 12, 2018

Related U.S. Application Data

(62) Division of application No. 14/369,836, filed as application No. PCT/JP2013/001023 on Feb. 22, 2013, now Pat. No. 9,950,364.

(30) Foreign Application Priority Data

Mar. 12, 2012 (JP) ..... 2012-054827

(51) Int. Cl.
*B22D 37/00* (2006.01)
*B22D 46/00* (2006.01)
(Continued)

(52) U.S. Cl.
CPC ..... *B22D 37/00* (2013.01); *B22D 41/04* (2013.01); *B22D 41/06* (2013.01); *B22D 46/00* (2013.01)

(58) Field of Classification Search
CPC ..... B22D 37/00; B22D 41/04; B22D 41/06; B22D 46/00
(Continued)

(56) References Cited

U.S. PATENT DOCUMENTS 3,818,971 A * 6/1974 Schutz ..... B22D 39/04 164/457
6,280,499 B1 8/2001 Koffron
(Continued)

FOREIGN PATENT DOCUMENTS

EP 2 140 955 1/2010
EP 2 143 513 1/2012
(Continued)

OTHER PUBLICATIONS

English-language International Search Report from the Japanese Patent Office for International Application No. PCT/JP2013/001023, dated Aug. 7, 2013.
(Continued)

*Primary Examiner* — Scott R Kastler
*Assistant Examiner* — Michael Aboagye
(74) *Attorney, Agent, or Firm* — Finnegan, Henderson, Farabow, Garrett & Dunner, LLP

(57) ABSTRACT

[Problem to Be Solved] A pouring control method for controlling an automatic pouring device with a tilting-type ladle is provided. By the method, a lip of a pouring ladle
(Continued)

approaches a sprue of a mold without striking any object located within the range of its movement. Also, by the method, the molten metal that runs out of the ladle can accurately fill the mold. [Solution] The pouring control method comprises the steps of setting a target flow rate of molten metal to be poured, generating a voltage to input it to a motor that tilts the ladle (hereafter, the tilting motor) so as to reach the target flow rate of the molten metal based on an inverse model of a mathematical model of molten metal that runs out of a pouring ladle and an inverse model of the tilting motor, estimating the flow rate of the molten metal that runs out of the ladle, estimating the falling position and getting the estimated falling position to be a target position, and generating a trajectory for the movement of the pouring ladle wherein the trajectory causes the height of the lip of the pouring ladle above the level of a sprite of a mold to decrease.

4 Claims, 7 Drawing Sheets

(51) Int. Cl.
*B22D 41/04* (2006.01)
*B22D 41/06* (2006.01)

(58) Field of Classification Search
USPC ..... 266/99, 236; 164/457, 155.1; 222/590, 222/591, 604
See application file for complete search history.

(56) References Cited

U.S. PATENT DOCUMENTS

| | | | | |
|---|---|---|---|---|
| 7,308,929 | B2 | 12/2007 | Beale | |
| 8,062,578 | B2 * | 11/2011 | Noda | B22D 37/00 222/590 |
| 9,248,498 | B2 * | 2/2016 | Noda | B22D 35/04 |

FOREIGN PATENT DOCUMENTS

| | | |
|---|---|---|
| EP | 2 143 514 | 1/2012 |
| JP | H09-001320 A | 1/1997 |
| JP | 2008-0272802 | 11/2008 |
| JP | 2011-224631 | 11/2011 |
| JP | 2012-016708 | 1/2012 |

OTHER PUBLICATIONS

Office Action for corresponding CN Application No. 102106887 dated Nov. 21, 2017.

* cited by examiner

[Fig. 1]
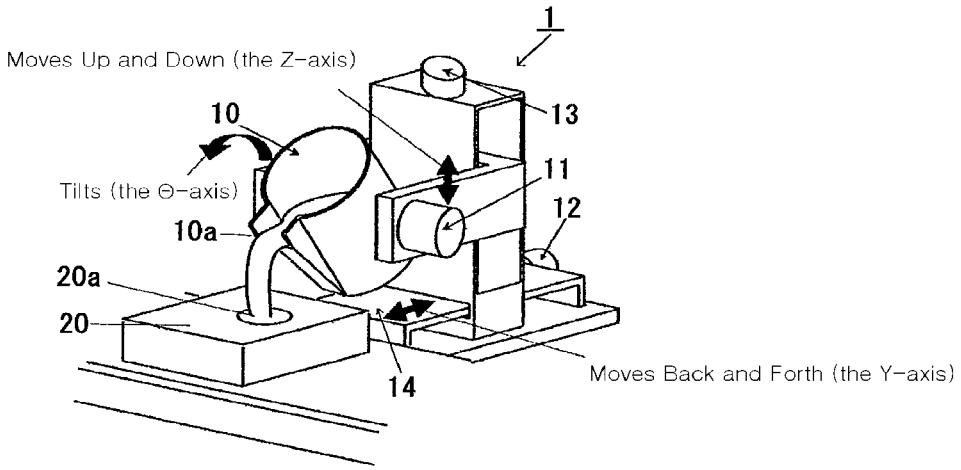
[Fig. 2]
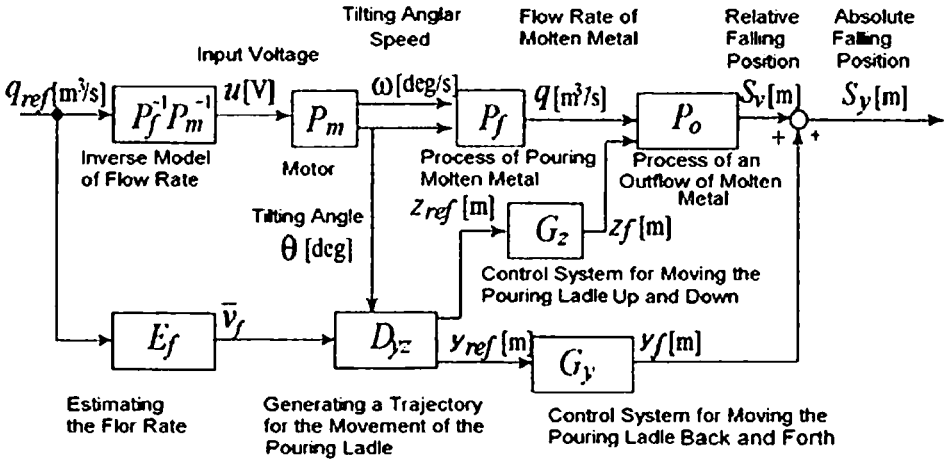

[Fig. 3]
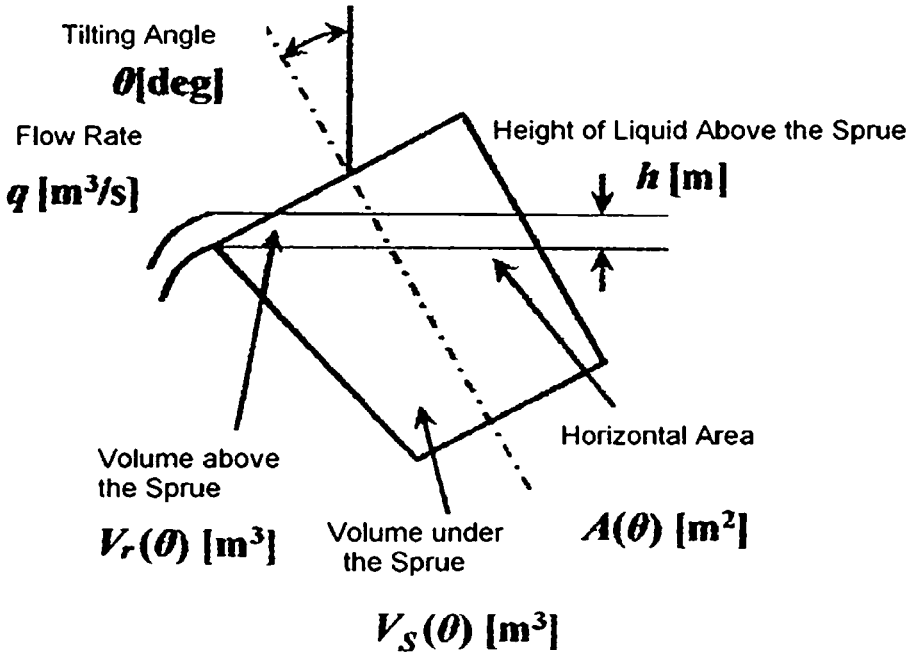

[Fig. 4]
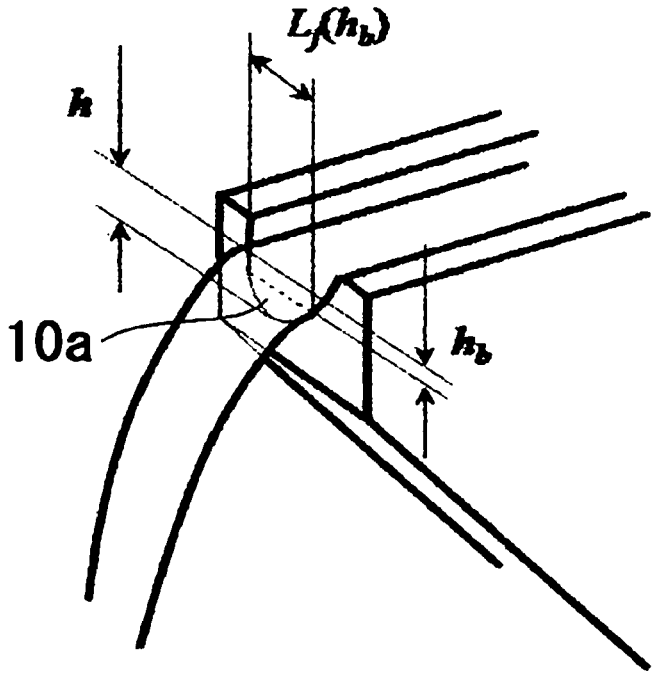
[Fig. 5]
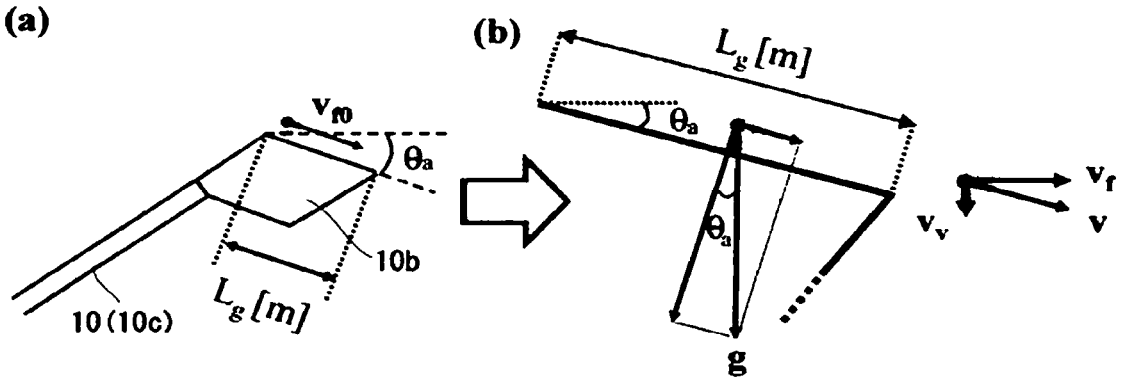

[Fig. 6]
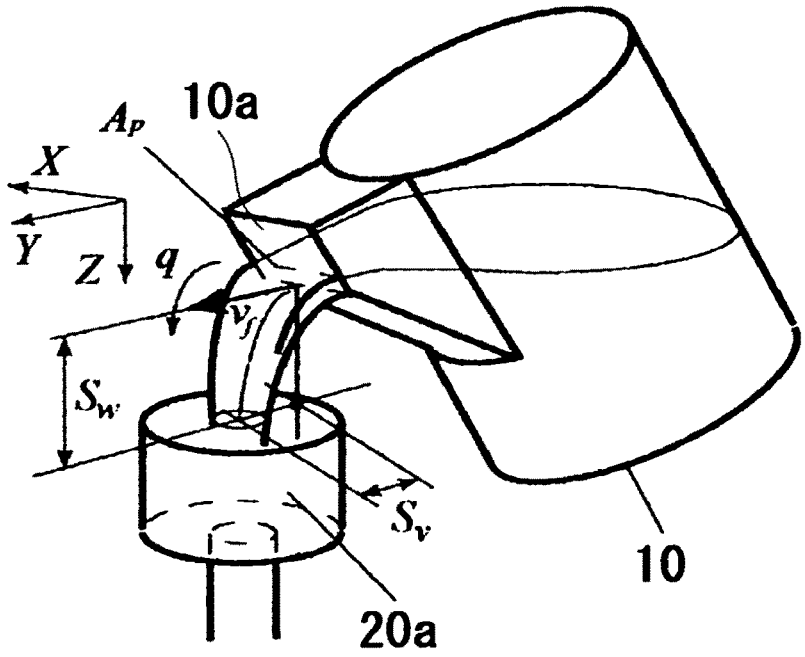
[Fig. 7]
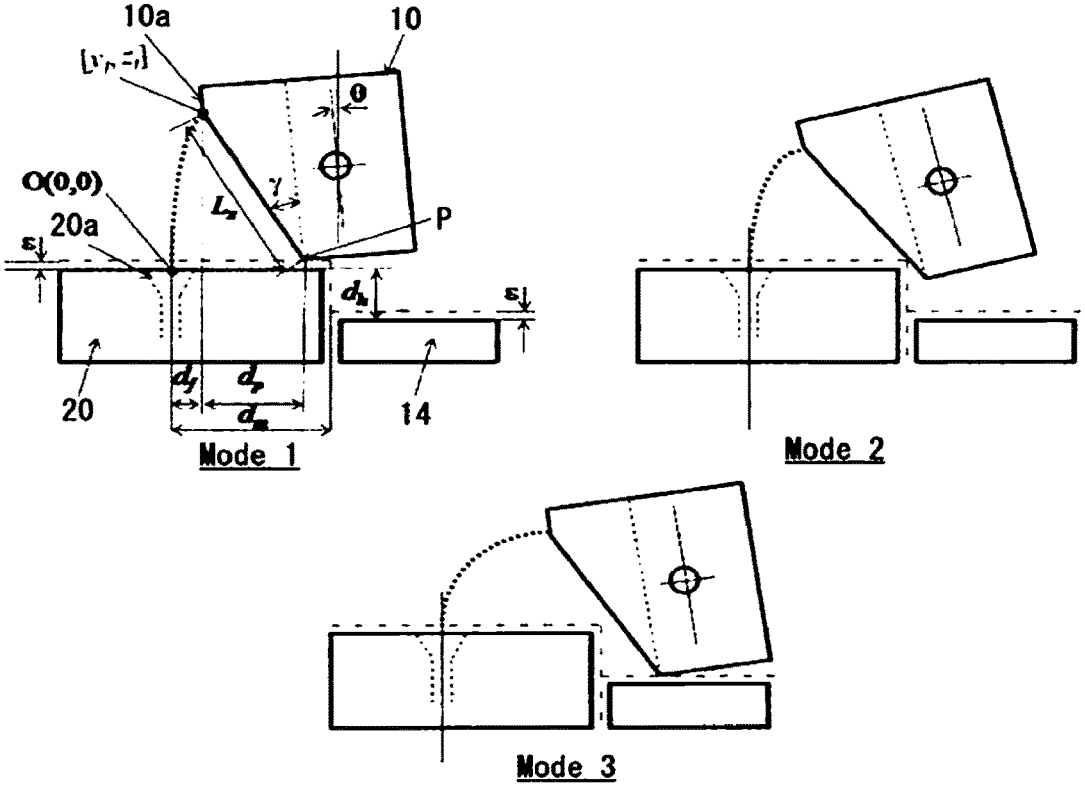

[Fig. 8]
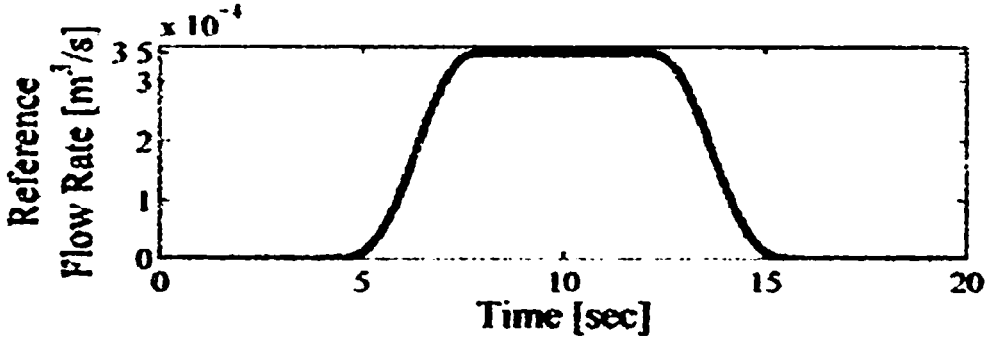
[Fig. 9]
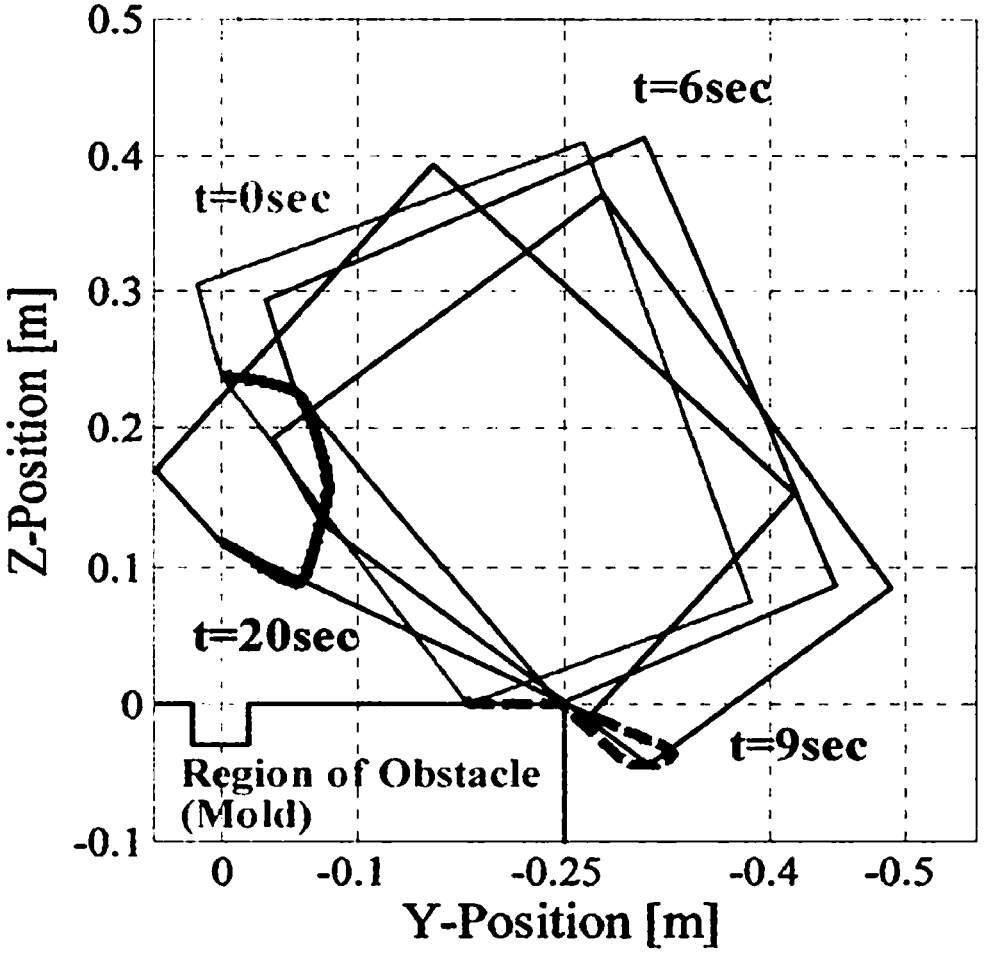

[Fig. 10]
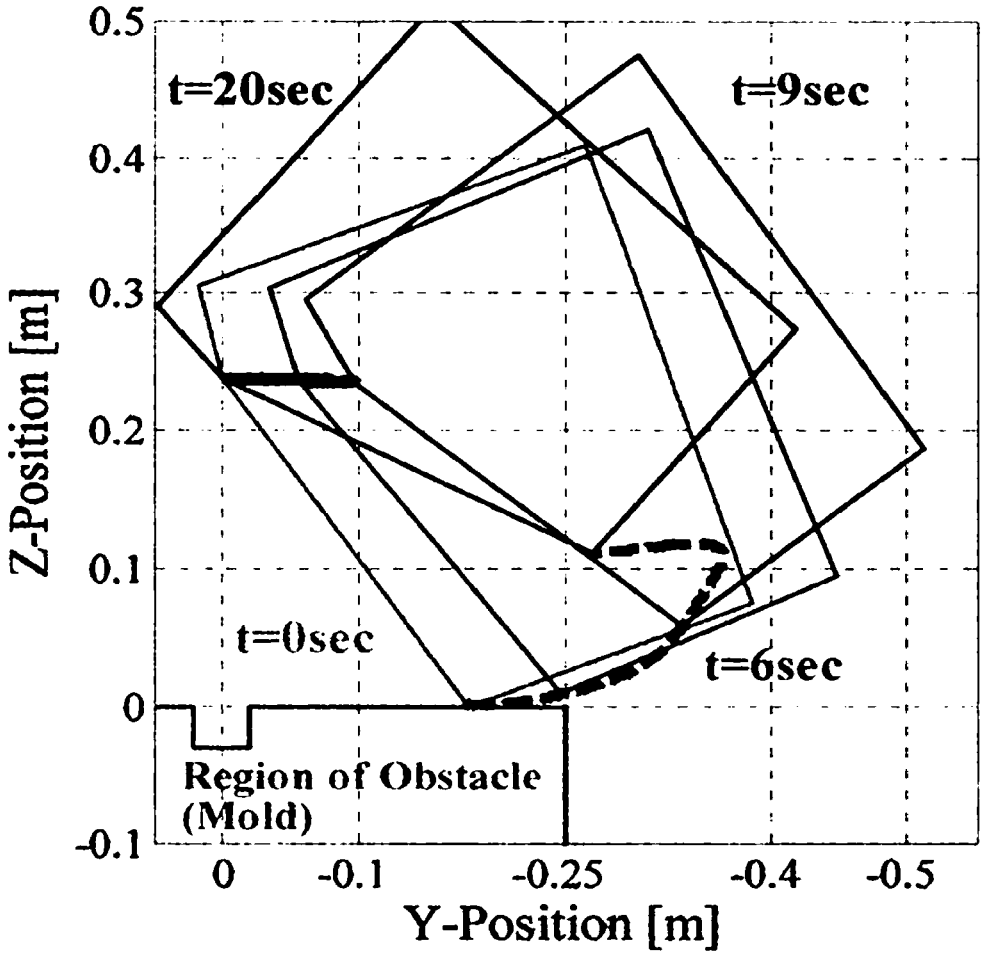

[Fig. 11]
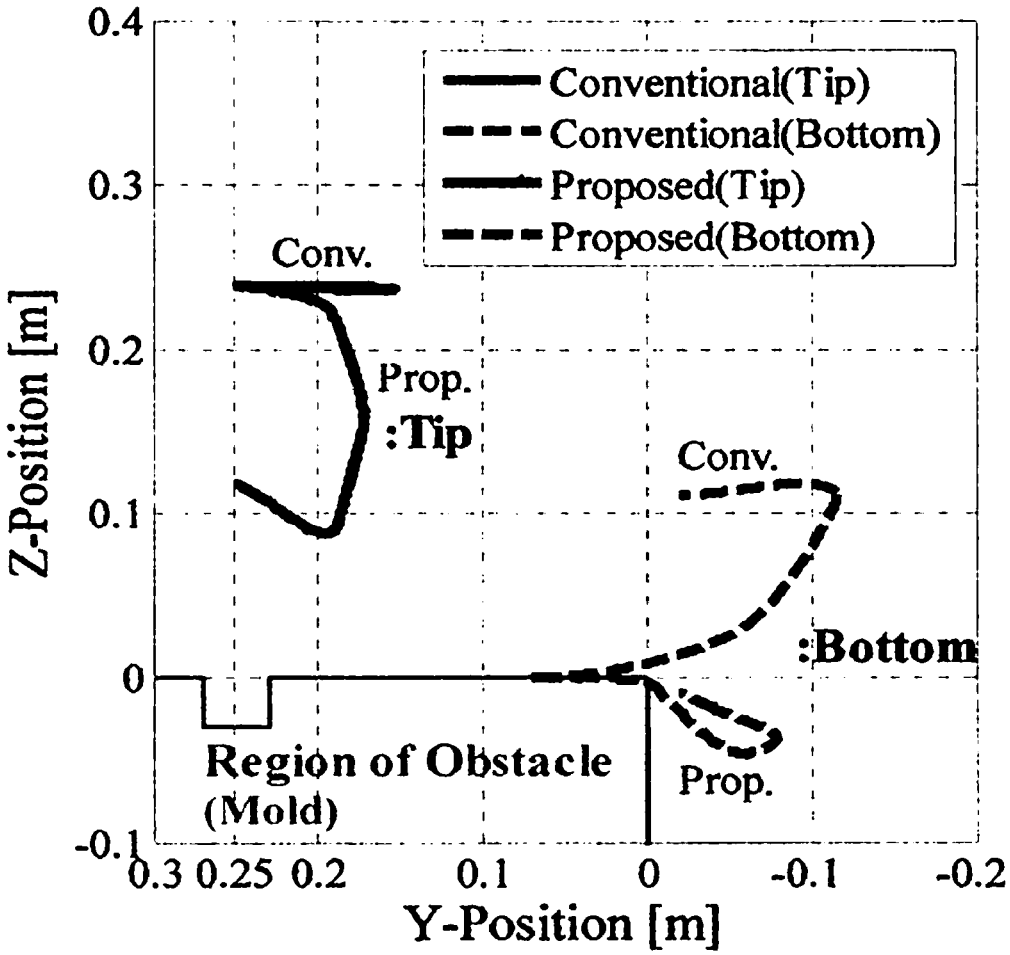

METHOD FOR A POURING CONTROL AND A STORAGE MEDIUM FOR STORING PROGRAMS FOR CAUSING A COMPUTER TO WORK AS A POURING CONTROL MEANS

This is a division of application Ser. No. 14/369,836, § 371(c) date of Jun. 30, 2014, now U.S. Pat. No. 9,950,364, issued Apr. 24, 2018, which is the National Stage of PCT/JP2013/001023, filing date of Feb. 22, 2013, and claims foreign priority to JP 2012-054827, filed Mar. 12, 2012, all of which are incorporated herein by reference.

TECHNICAL FIELD

This invention relates to a method for controlling an automatic pouring device (hereafter, a pouring control) with a tilting-type ladle that tilts the ladle filled with molten metal to pour it into a mold. Also, the invention relates to a storage medium for storing programs for causing a computer to work as a pouring control means.

BACKGROUND

Some methods for controlling an automatic pouring device with a tilting-type ladle are proposed. One of them controls the position on which molten metal that runs out of a pouring ladle falls (hereafter, the falling position), by using a feed forward control (PTL 1). Another one has a feedback control so that it can correct any difference that occurs as a result of a control of the falling position of molten metal by using a feed forward control (PTL 2). Another one controls a movement of a mold so that the molten metal that runs out of a pouring ladle is accurately filled in the mold (PTL 3), etc.

LIST OF CITATIONS

Patent Literature (PTL 1)
Japanese Patent Laid-open Publication No. 2008-272802
(PTL 2)
Japanese Patent Laid-open Publication No. 2011-224631
(PTL 3)
Japanese Patent Laid-open Publication No. 2012-16708

SUMMARY OF INVENTION

Technical Problem

By the technology disclosed by PTL 1, the position on which molten metal that runs out of a pouring ladle falls is controlled by using a feed-forward control. By the technology disclosed by PTL 2, if the falling position differs from a target position, and even if the position is controlled by the falling position control disclosed by PTL 1, a pouring ladle will go forward or backward so as to eliminate the difference. However, by the technologies disclosed by PTL 1 and PTL 2, a lip of a pouring ladle does not vertically get closer to a sprue of a mold. Thus, the pouring of molten metal may be carried out from a high position. Therefore, the temperature of the molten metal may decrease, because the free-fall time of the molten metal that runs out of the pouring ladle can be long. Also, the molten metal can be scattered when it contacts the sprue of the mold, because the velocity of the metal that runs out of the ladle can be high when the metal reaches the sprue. A pouring ladle should be moved vertically so as to cause the vertical distance between the lip of the pouring ladle and the sprue of the mold to become shorter. If the ladle is moved vertically, it can strike a mold or a pedestal of a device such as a device for pouring molten metal. Also, by the technology disclosed by PTL 3, since it uses a device for moving a mold, new equipment is needed. Also, it does not ensure that the ladle will not strike any pedestal located around the mold.

The invention of this application aims to provide a pouring control method and a storage medium for controlling an automatic pouring device with a tilting-type ladle. By the method, a lip of a pouring ladle approaches a sprue of a mold without striking a mold and any object located within the range of its movement. Also, by the method, the molten metal that runs out of the ladle can accurately fill the mold.

Solution to Problem

The present invention was made to accomplish these aims. The invention of claim 1 uses a technical means, i.e., it is a pouring control method for an automatic pouring device with a tilting-type pouring ladle. The device can control the movements of the ladle in the back and forth and up and down directions, and can also control its tilting. The method comprises the steps of setting a target flow rate of molten metal to be poured, generating a voltage to input it to a motor that tilts the ladle (hereafter, the tilting motor) so as to reach the target flow rate of the molten metal, based on an inverse model of a mathematical model of molten metal that runs out of a pouring ladle and an inverse model of the tilting motor, estimating the flow rate of the molten metal that runs out of the ladle, estimating the falling position and getting the estimated falling position to be a target position, and generating a trajectory for the movement of the pouring ladle wherein the trajectory causes the height of the lip of the pouring ladle above the level of a sprue of a mold to decrease and causes the ladle not to strike any object located within the range of its movement, controlling the movement of the pouring ladle and pouring the molten metal into the mold so that the height of the lip of the pouring ladle above the level of the sprue of the mold decreases and so that the ladle does not strike the object when the molten metal is being poured into the mold.

By the invention of claim 1, since the falling position of the molten metal is controlled, the molten metal that runs out of the ladle can be accurately poured into the sprue of the mold. Namely, a trajectory for the movement of the pouring ladle is generated so that the trajectory causes the ladle not to strike any object located within the range of its movement. Based on the trajectory, the movement of the pouring ladle is controlled so that the height of the lip of the pouring ladle above the level of a sprue of a mold decreases, and so that the molten metal is poured into the mold. Thus the free-fall time of the molten metal poured from the pouring ladle can be shortened, compared to that of a conventional pouring control method in which no lip of a pouring ladle is controlled to have it approach a sprue of a mold. Also, any decrease in the temperature of the molten metal can be restricted. Further, the velocity of the molten metal when the metal reaches the sprue can be lowered, and so scattering of the metal can be restricted.

The invention of claim 2 uses a technical means that includes steps that are carried out after the step of generating a trajectory for the movement of the pouring ladle in the method of claim 1. Namely, the trajectory is generated based on the mode in which the pouring ladle is going to strike the object (hereafter, the striking mode), which mode is previously set, and based on the conditions for changing the movement of the ladle, which conditions are decided based on the striking mode.

By the invention of claim 2, when the trajectory of the movement is generated, the shape of the pouring ladle, the relationship between the locations of the ladle and the object that is positioned within the range of its movement, etc., is considered, and then the trajectory can be generated based on the striking mode, in which the pouring ladle is going to strike the object, which mode is previously set, and based on the conditions for changing the movement of the ladle, which conditions are based on the striking mode.

The invention of claim 3 uses a technical means, i.e., it is a pouring control method for an automatic pouring device with a tilting-type pouring ladle. The device can control the movement of the ladle in the back and forth and up and down directions, and also can control its tilting. The method comprises the steps of setting a target flow rate of molten metal to be poured, generating a voltage to be input to a tilting motor so as to reach the target flow rate of the molten metal based on an inverse model of a mathematical model of the molten metal that runs out of a pouring ladle and an inverse model of the tilting motor that tilts the ladle, estimating the flow rate of the molten metal that runs out of the ladle, estimating the falling position of the molten metal and getting the falling position to be a target position, setting a hypothetical axis at the lip of the ladle, generating a second trajectory for the movement of the pouring ladle wherein the trajectory causes the ladle not to strike any object located within the range of its movement and minimizes the height of the lip of the pouring ladle above the level of a sprue of a mold, controlling the movement of the pouring ladle so that the ladle does not strike the object when the molten metal is being poured into the mold, and pouring the molten metal into the mold by turning the ladle around the hypothetical axis set at the lip of the ladle.

By the invention of claim 1, since the falling position of the molten metal is controlled, the molten metal that runs out of the ladle can be accurately poured into the sprue of the mold. Namely, a trajectory for the movement of the pouring ladle is generated so that the trajectory causes the ladle not to strike any object located within the range of its movement and minimizes the height of the lip of the ladle above the level of the sprue of the mold. Based on the trajectory, the movement of the pouring ladle is controlled so that the ladle turns around a hypothetical axis and the molten metal is poured into the mold. Thus, the free-fall time of the molten metal poured from the pouring ladle can be shortened. Also, the decrease in the temperature of the molten metal can be restricted. Further, the velocity of the molten metal when the metal reaches the sprue of the mold can be lowered and scattering of the metal can be restricted. Since the height of the lip of the ladle is constant when the molten metal is being poured, the pouring can be less affected by an external disturbance. Also, the electric power necessary to move the pouring ladle can be less.

The invention of claim 4 uses a technical means that includes steps that are carried out after the step of generating a second trajectory for the movement of the pouring ladle in the method of claim 3. Namely, at that step, the second trajectory decides the location of the ladle based on the striking mode, which mode is previously set.

By the invention of claim 4, when the second trajectory of the movement is generated, the shape of the pouring ladle, the relationship between the locations of the ladle and the object that is positioned within the range of its movement, etc., is considered, and then the location of the ladle can be decided based on the striking mode, which mode is previously set.

A medium invention uses a technical means, i.e., it is a medium that is readable by a computer in which a program is stored. The program causes the computer to carry out pouring control processes for an automatic pouring device with a tilting-type pouring ladle. The device can control the movement of the ladle in the back and forth and up and down directions, and also can control its tilting. The processes comprise setting a target flow rate of molten metal to be poured, generating a voltage to be input to a tilting motor so as to reach the target flow rate of the molten metal, based on an inverse model of a mathematical model of molten metal that runs out of a pouring ladle and an inverse model of the tilting motor, estimating the flow rate of the molten metal that runs out of the ladle, estimating the falling position of the molten metal and getting the falling position to be a target position, and generating a trajectory for the movement of the pouring ladle wherein the trajectory causes the height of the lip of the pouring ladle above the level of a sprue of a mold to decrease and causes the ladle not to strike any object located within the range of its movement.

Another medium invention uses a technical means, i.e., it is a medium that is readable by a computer in which a program is stored. The program causes the computer to carry out pouring control processes for an automatic pouring device with a tilting-type pouring ladle. The device can control the movement of the ladle in the back and forth and up and down directions, and also can control its tilting. The processes comprise setting a target flow rate of molten metal to be poured, generating a voltage to be input to a tilting motor so as to reach the target flow rate of the molten metal based on an inverse model of a mathematical model of molten metal that runs out of a pouring ladle and based on an inverse model of the tilting motor, estimating the flow rate of the molten metal that runs out of the ladle, estimating the falling position of the molten metal and getting the falling position to be a target position, setting a hypothetical axis at the lip of the ladle, and generating a second trajectory for the movement of the pouring ladle wherein the trajectory causes the ladle not to strike any object located within the range of its movement and minimizes the height of the lip of the pouring ladle above the level of a sprue of a mold.

By the medium inventions, the pouring control method of the invention of this application is applied to a program for controlling the pouring of molten metal that can cause the computer to carry out the method and is also applied to a storage medium that is readable by a computer and in which the program is stored.

BRIEF DESCRIPTION OF DRAWINGS

FIG. 1 is a schematic view of one example of an automatic pouring device with a tilting-type ladle.

FIG. 2 is a block diagram of a control system for pouring molten metal.

FIG. 3 is a schematic cross-section view of a pouring ladle.

FIG. 4 is a schematic perspective view that shows the end of a lip of a pouring ladle.

FIG. 5 is a schematic cross-section view that shows the conditions when molten metal flows into a guide of the lip.

FIG. 6 is a schematic perspective view that shows a process for pouring molten metal.

FIG. 7 is a schematic view of a striking mode in which a pouring ladle strikes an object within the range of its movement.

FIG. 8 is a schematic diagram that shows a target flow that should be given when an experiment is carried out for obtaining for a trajectory a pouring ladle.

FIG. 9 is a schematic diagram that shows trajectories of a movement of a pouring ladle as a result of an experiment using a conventional method.

FIG. 10 is a schematic diagram that shows various possible trajectories of a pouring ladle as a result of an experiment using the pouring control method of the invention of this application.

FIG. 11 is a schematic diagram that shows trajectories of the end of a lip of a pouring ladle and its bottom, of the invention of this application, compared to a conventional one.

DESCRIPTION OF EMBODIMENTS

Now, based on drawings we discuss the pouring control method of the invention of this application.

FIG. 1 shows an example of an automatic pouring device with a tilting-type ladle to which the pouring control method of the invention of this application is applied. The automatic pouring device with a tilting-type ladle 1 comprises a pouring ladle 10 and servomotors 11, 12, and 13. The pouring ladle 10 carries molten metal. One of the servomotors is a servomotor 11 that tilts and also turns the ladle 10 around an axis θ. Another servomotor 12 moves the ladle 10 in the back and forth directions. The third servomotor 13 moves the ladle 10 up and down.

Since the servomotors 11, 12, and 13 each have rotary encoders, the position and the angle of the tilting of the pouring ladle 10 can be determined. The servomotors 11, 12, and 13 are configured to be given a command signal from a computer. The "computer" in this disclosure denotes a motion controller such as a personal computer, a micro computer, a programmable logic controller (PLC), and a digital signal processor (DSP).

The automatic pouring device 1 can control the servomotors 11, 12, and 13 in the construction as described above and cause the pouring ladle 10 to move on a predetermined trajectory. Then it can discharge the molten metal from a lip 10*a* and pour it into a mold 20 through a sprue 20*a* of the mold 20.

In the automatic pouring device with a tilting-type ladle 1, a position control system for the pouring ladle is used. The control system can control the device so that the pouring ladle 10 does not strike the mold 20 or any object within the range of the movement of the ladle 10 such as the pedestal 14 of the automatic pouring device 1, and so that the lip 10*a* of the ladle 10 advances to the sprue 20*a* of the mold 20 and accurately pours the molten metal into the sprue 20*a*. Shown below is a mathematical model that includes a process starting with sending a control command signal to the servomotor to determine a falling position in the horizontal direction of the molten metal that runs out of a pouring ladle 10.

The Pf shown in FIG. 2 is a process of pouring the molten metal that runs out of the pouring ladle 10 by causing the ladle 10 to be tilted.

FIG. 3 shows a schematic cross-section view of the pouring ladle 10 when the molten metal is being poured. If the angle of the tilting of the pouring ladle 10 is θ [deg], if the volume of the part of the molten metal of the part that is lower than the lip 10*a* of the pouring ladle 10 is $V_s$ (θ) [m3], if the area of the horizontal plane formed by the metal in the lip 10*a* is A (θ) [m3], if the volume of the part of the molten metal of the part that is above the lip 10*a* is $V_r$ [m3], if the height of the molten metal above the lip 10*a* is h [m], and if the flow rate of the molten metal that runs out of the pouring ladle 10 is q [m3/s], then the material balance at Δt [s] after the time t [s] when the molten metal is poured will be represented by the following equation (1).

[Math.1]

$$V_r(t)+V_s(\theta(t))=V_r(t+\Delta t)+V_s(\theta(t+\Delta t))+q(t)\Delta t \tag{1}$$

If equation (1) is rearranged to calculate the volume of the molten metal Vr [m3], and if Δt→0, then equation (2) will be obtained.

[Math. 2]

$$\lim_{\Delta t\to 0}\frac{V_r(t+\Delta t)-V_r(t)}{\Delta t}=\frac{dV_r(t)}{dt}=-q(t)-\frac{dV_s(\theta(t))}{dt}=-q(t)-\frac{\partial V_s(\theta(t))}{\partial\theta(t)}\frac{d\theta(t)}{dt} \tag{2}$$

The angular speed ω [deg/s] of the pouring ladle 10 is represented as equation (3).

[Math. 3]

$$\omega(t)=\frac{d\theta(t)}{dt} \tag{3}$$

If equation (3) is substituted for equation (2), then equation (4) will be obtained.

[Math. 4]

$$\frac{dV_r(t)}{dt}=-q(t)-\frac{\partial V_s(\theta(t))}{\partial\theta(t)}\omega(t) \tag{4}$$

The volume $V_r$ [m3] of the molten metal of the part that is above the lip is represented as equation (5).

[Math.5]

$$V_r(t)=\int_0^{h(t)}A_s(\theta(t),h_s)dh_s \tag{5}$$

The symbol $A_s$ [m2] denotes the horizontal area of the molten metal at the height $h_s$ [m] above the horizontal plane of the lip.

If the area $A_s$ [m2] is divided into area A [m2] and the incremental value of the area $\Delta A_s$ [m2], then the volume of the molten metal $V_r$ [m3] will be represented by the following equation (6).

[Math.6]

$$V_r(t)=\int_0^{h(t)}(A(\theta(t))+\Delta A_s(\theta(t),h_s))dh_s=A(\theta(t))h(t)+\int_0^{h(t)}\Delta A_s(\theta(t),h_s)dh_s \tag{6}$$

As for a commonly used pouring ladle, the incremental value of the area $\Delta A_s$ [m2] is very small compared to the area A [m2] of the horizontal plane of the lip. Thus, the following equation (7) is obtained.

[Math.7]

$$A(\theta(t))h(t)>>\int_0^{h(t)}\Delta A_s(\theta(t),h_s)dh_s \tag{7}$$

Accordingly, equation (6) can be represented by equation (8).

[Math.8]

$$V_r(t) \approx A(\theta(t))h(t) \tag{8}$$

Therefore, equation (9) is obtained from equation (8).

[Math. 9]

$$h(t) \approx \frac{V_r(t)}{A(\theta(t))} \tag{9}$$

Equation (10) is obtained from equation (9).

[Math. 10]

$$\frac{dh(t)}{dt} = -\frac{1}{A(\theta(t))}\left(q(t) + \left(\frac{\partial V_s(\theta(t))}{\partial \theta(t)} + \frac{\partial A(\theta(t))}{\partial \theta(t)}h(t)\right)\omega(t)\right) \tag{10}$$

By using Bernoulli's theorem, the flow rate of the molten metal q [m3/s] is represented by equation (11) at the height h [m] of the molten metal above the lip 10*a*.

[Math. 11]

$$q(t) = c\int_0^{h(t)} L_f(h_b)\sqrt{2gh_b}\,dh_b \tag{11}$$

The symbol $h_b$ [m] denotes the depth of the molten metal in the pouring ladle from its surface as in FIG. 4. $L_f$ [m] is the width of the lip, g [m/s$^2$] is the acceleration of gravity, and c is the flow rate coefficient.

From the above, the process Pf of pouring molten metal is represented by equations (10) and (11).

The symbol $P_m$ shown in FIG. 2 denotes the dynamic characteristics of a servomotor that tilts a pouring ladle 10, and they are represented by the following equations.

[Math. 12]

$$T\frac{d\omega(t)}{dt} + \omega(t) = Ku(t) \tag{12}$$

[Math. 13]

$$\frac{d\theta(t)}{dt} = \omega(t) \tag{13}$$

The symbol ω [deg/s] is an angular speed of tilting, u [V] is an input voltage, T [s] is a time constant, and K [deg/s/V] is a gain constant.

Now we discuss a method for estimating the falling position of the molten metal when it is being poured.

In a model of a process of an outflow of molten metal, the length of the drop of molten metal in the horizontal direction $S_v$ [m] can be obtained by the product of a velocity of the outflow $v_f$ [m/s] times the falling time $T_f$ [s], and the length can be represented by an equation using $v_f$ [m/s] and a height $S_w$ [m], which height is the position where the molten metal reaches. The outflow velocity $v_f$ [m/s] is represented by a primary expression, considering the effect of its contraction, wherein the result obtained by dividing the flow rate q [m$^3$/s] of a molten metal by a cross sectional area $A_p$ [m2] of the molten metal at the lip 10*a* is used.

[Math. 14]

$$v_{f0}(t) = \alpha_1\left(\frac{q(t)}{A_p(h(t))}\right) + \alpha_0 \tag{14}$$

[Math. 15]

$$v(t) = \sqrt{v_{f0}^2 + 2L_g g\sin\theta_a} \tag{15}$$

[Math. 16]

$$v_f(t) = v\cos\theta_a \tag{16}$$

[Math. 17]

$$T_f = \frac{-v\sin\theta_a + \sqrt{(v\sin\theta_a)^2 + 2S_w g}}{g} \tag{17}$$

[Math. 18]

$$S_v(\theta_a, v, S_w) = v_f T_f = \frac{-v^2\sin\theta_a\cos\theta_a + v\cos\theta_a\sqrt{(v\sin\theta_a)^2 + 2S_w g}}{g} \tag{18}$$

The symbol $v_{f0}$ [m/s] denotes a flow rate of the molten metal when it flows into the guide of the lip 10*b* as in FIG. 5. The symbols $\alpha_0$ and $\alpha_1$ are coefficients of the effects when the molten metal runs out of the pouring ladle 10, i.e., its cross sectional area is contracted and its flow rate is increased at the lip by the effect of gravity.

The symbol $\theta_n$ [deg] in equations (15)-(18) denotes the angle of the tilting of the lip 10*a* at its end to the horizontal plane. Suppose that the angle of the tilting of the end of the lip 10*a* is φ [deg], wherein the pouring ladle 10 is vertical. If the angle of the tilting of the pouring ladle is θ [deg], then the angle will be represented by the following equation.

[Math.19]

$$\theta_a(t) = \theta(t) + \phi \tag{19}$$

$L_g$ [m] is the length of the guide of the lip 10*b*, *v* [m/s] is the velocity of the molten metal when it runs out of the guide 10*b*, $v_f$ [m/s] is the horizontal component of the velocity of the molten metal when it runs out of the guide 10*b*, and $T_f$ [S] is the free-fall time of the molten metal that runs out of the guide 10*b*. As in FIG. 6, $S_w$[m] is the vertical length between the lip 10*a* and the sprue 20*a* of the mold 20, and $S_v$ [m] is the horizontal length between the lip 10*a* and the sprue 20*a*. By defining the vertical length between the lip 10*a* and the top surface of the sprue 20*a* as $S_w$ [m], the position in the horizontal direction on which the molten metal falls $S_v$ [m] can be determined.

Based on that mathematical model, a control system is constructed, wherein the control system estimates the position on which the molten metal falls and controls the position. By using the equation (11), the height $h_{ref}$ [m] of the molten metal above the lip can be obtained by the following equation. From that height $h_{ref}$ [m], a target flow rate $q_{ref}$ [m3/s] of molten metal that is being poured will be reached.

[Math.20]

$$h_{ref}(t) = f^{-1}(q_{ref}(t)) \tag{20}$$

If equation (4) is replaced by equations (9) and (20) and rearranged, the tilting angular speed $\omega_{ref}$ [deg/s] of tilting the pouring ladle will be represented by the following equation, and an inverse model of the process for pouring molten metal will be obtained. By using that angular speed $\omega_{ref}$ [deg/s], the height lire [m] of the molten metal above the lip will be reached.

[Math. 21]

$$\omega_{ref}(t) = -\frac{A(\theta(t))\frac{dh_{ref}(t)}{dt} + q_{ref}(t)}{\frac{\partial V_s(\theta(t))}{\partial\theta(t)} + \frac{\partial A(\theta(t))}{\partial\theta(t)}h(t)} \tag{21}$$

The input voltage u [V] that is to be input to a servomotor is derived from the inverse model $P_m^{-1}$ of the dynamic characteristics of a servomotor that tilts a pouring ladle 10. The voltage causes the servomotor to let the flow of the molten metal that is being poured reach the target flow rate $q_{ref}$ [$m^3$/s]. The model $P_m^{-1}$ is derived from equation (12) as in the following equation.

[Math. 22]

$$u(t) = \frac{T}{K}\frac{d\omega_{ref}(t)}{dt} + \frac{1}{K}\omega_{ref}(t) \tag{22}$$

By sequentially calculating the solutions of equations (20)-(22), the input voltage u [V] that causes the servomotor to let the flow reach the target flow rate $q_{ref}$ [m3/s] of molten metal can be obtained.

Now, we discuss the block for generating a trajectory for the movement of a pouring ladle. In this block $D_{yz}$, the position on which the molten metal falls is estimated and the position is set as a target position. The trajectory causes the lip 10*a* of the ladle 10 to approach the sprue 20*a* of the mold 20 and the molten metal is accurately poured into the sprue of the mold without the pouring ladle 10 striking the mold 20 or a pedestal 14 or other objects. In this embodiment, we discuss a case in which a box-shaped pouring ladle is used.

A feed forward control system that uses an inverse model of the flow rate $P_f^{-1}P_m^{-1}$ for controlling the flow rate of molten metal that is to be poured causes the actual flow of molten metal to follow a pattern of a target flow. Thus it causes the actual flow to correspond to the target flow rate $q_{ref}$ [m3/s] of the molten metal. The position on which the molten metal falls (the falling position) can be estimated by using the target flow rate $q_{ref}$ [m3/s] and the flow rate of the molten metal that is estimated in the block for estimating the flow rate $E_f$. Then a control for the falling position is carried out by moving the pouring ladle 10 to the place from which, if the molten metal is poured, the estimated falling position will be the target position, i.e., the position just on the sprue 20*a* of the mold 20.

The relative falling position $S_v$ [m] is the horizontal distance between the position on which the molten metal falls and the end of the lip 10*a*. The absolute falling position $S_y$ [m] is the horizontal distance between the position on which the molten metal falls and the origin of a coordinate system. The origin is the center of the sprue 20*a* on the surface of a mold 20.

The positions of objects are shown in FIG. 7, wherein the objects exist within the range of movement of a pouring ladle 10. They could be struck with the ladle 10 when the molten metal is being poured, i.e., in this case they are a mold 20 and a pedestal 14. When a trajectory of the movement of a pouring ladle 10 is determined, the originating point of the X-Y coordinate is defined as the center of the sprue 20*a* on the surface of a mold 20. The symbols $y_f$ and $z_f$ [m] denote the coordinates of the end of a lip, and $y_b$ and $z_b$ [m] denote the coordinates of the end p of the bottom of a pouring ladle. The symbol $L_s$ [m] denotes the length of the lateral side 10*c* of the front part of the pouring ladle, and γ [deg] denotes the angle of the slant of the lip-side of the pouring ladle in relation to a vertical line. The symbol $d_m$ [m] denotes the length from the end p to the center of a sprue 20*a* of a mold. The symbol $d_p$ [m] denotes the length of the drop of molten metal in the y-axis. The symbol $d_p$ [m] denotes the length between the projecting point of the end of the lip 10*a* on the y-axis and the projecting point of the end p on a y-axis. The symbol $d_h$ [m] denotes the difference between the height of the top surface of a mold 20 and that of a pedestal 14.

About the changes of the position of the pouring ladle 10 when it approaches the mold 20 or the pedestal 14, the ways to approach it can be divided into the following three modes, as in FIG. 7. Mode 1 is the way by which the lower front end p of the pouring ladle 10 reaches the nearest position above the top surface of the mold 20. Mode 2 is the way by which the lateral front side 10*c* of the pouring ladle 10 reaches the nearest position to the end of the mold 20. Mode 3 is the way by which the lower front end p of the pouring ladle 10 reaches the nearest position above the top surface of the pedestal 14. In this embodiment, a region not to be entered is defined by the areas below the predetermined height e above their upper surfaces. The pouring ladle 10 is controlled so as not to enter the region.

Each mode follows the following conditions, which are determined based on the relative positions of the pouring ladle 10, the mold 20, the pedestal 14, etc. The movement of the pouring ladle 10 is changed corresponding to each mode and the position $[y_f, z_f]$ of the pouring ladle is calculated so that the ladle does not strike the mold 20 or the pedestal 14 or other objects and so that the molten metal is accurately poured into the sprue of the mold. The indices 1-3 respectively correspond to modes 1-3. The conditions in equation (23) are those in which a box-shaped pouring ladle is used. These are set corresponding to the shape of the front lateral part of the pouring ladle.

[Math. 23]

$$[y_f, z_f] = \begin{cases} [y_{f1}, z_{f1}], & (d_f + d_p < d_m) \\ [y_{f2}, z_{f2}], & (d_f + d_p \geq d_m \wedge L_s\cos(\theta+\gamma) + \varepsilon < d_h) \\ [y_{f3}, z_{f3}], & (d_f + d_p \geq d_m \wedge L_s\cos(\theta+\gamma) + \varepsilon \geq d_h) \end{cases} \tag{23}$$

The symbols $d_f$ and $d_p$ are represented as follows.

[Math.24]

$$d_f = S_v(\theta, v, L_s\cos(\gamma+\theta)+\varepsilon) \tag{24}$$

[Math.25]

$$d_p = L_s\sin(\gamma+\theta) \tag{25}$$

The position of the pouring ladle in each mode is derived as follows.

<Mode 1>

In mode 1, a pouring ladle is moved so that the distance c between its end P and the top surface of a mold 20 is kept constant. The position Z in the vertical direction and the position Y in the back and forth directions of the pouring ladle are obtained as follows.

[Math.26]

$$z_{f1} = L_s\cos(\theta+\gamma)+\varepsilon \tag{26}$$

[Math.27]

$$y_{f1}=S_v(\theta,v,z_{f1}) \tag{27}$$

<Mode 2>

In mode 2, a pouring ladle is moved so that the height of its end P continuously changes in correspondence to its tilting. Namely, when the position of the end P is lower than the origin of the coordinate system, the ladle is moved so that the end of the lip 10*a* is kept lower. The position of the pouring ladle in the vertical direction can be obtained by calculating the following equation for $z_f$.

[Math.28]

$$S_v(\theta,v,z_f)+z_f\tan(\theta+\gamma)=d_m \tag{28}$$

The numerical solution of equation (28) can be obtained by using a method for obtaining a numerical solution such as the Newton-Raphson method. In certain cases, in which the pouring ladle has a certain shape, an analytical solution can be obtained. Here we discuss a process to derive the vertical position of the pouring ladle by using the Newton-Raphson method. If equation (28) is replaced with equations (17)-(19), then the following equation will be obtained.

[Math. 29]

$$f=\frac{-v^2\sin\theta_a\cos\theta_a+v\cos\theta_a\sqrt{(v\sin\theta_a)^2+2z_fg}}{g}+z_f\tan(\theta+\gamma)-d_m \tag{29}$$

If equation (29) is differentiated with respect to $z_f$, it will be as follows.

[Math. 30]

$$f'=\frac{v\cos\theta_a}{\sqrt{(v\sin\theta_a)^2+2z_fg}}+\tan(\theta+\gamma) \tag{30}$$

Therefore, the $z_{in}$ will be obtained by repeatedly using the following equation.

[Math. 31]

$$z_{fn+1}=z_{fn}-\frac{f_n}{f_n'} \tag{31}$$

$$f_n=\frac{-v^2\sin\theta_a\cos\theta_a+v\cos\theta_a\sqrt{(v\sin\theta_a)^2+2z_fg}}{g}+z_{fn}\tan(\theta+\gamma)-d_m$$

$$f_n'=\frac{v\cos\theta_a}{\sqrt{(v\sin\theta_a)^2+2z_{fn}g}}+\tan(\theta+\gamma)$$

The vertical position of the pouring ladle is used as an initial value $z_{f0}$ for the repeated usage of the equation (31). The vertical position, as the initial value, has been obtained by solving equation (31) with respect to the value that is obtained before one sampling period. The calculated vertical position of the ladle is assigned to the following equation as a vertical position of the ladle $z_{f2}$, and then the position Y in the back and forth directions of the pouring ladle is obtained.

[Math.32]

$$y_{f2}=S_v(\theta,v,z_{f2}) \tag{32}$$

<Mode 3>

In mode 3, a pouring ladle is moved so that the distance c from its end P to the top surface of a pedestal 14 is kept constant. The position of the pouring ladle in the vertical direction is obtained, using the result in mode 2, as follows.

[Math.33]

$$z_{f3}=L_s\cos(\theta+\alpha)+\varepsilon-d_h \tag{33}$$

The position $y_{f3}$ of the pouring ladle in the back and forth directions can be obtained by putting the vertical position of the ladle $z_{f3}$ in the following equation.

[Math.34]

$$y_{f3}=S_v(\theta,v,z_{f3}) \tag{34}$$

The $y_f$ and $z_f$ that are obtained by the equations (23)-(34) are respectively changed to $y_{ref}$ and $z_{ref}$, and input into the system $G_y$ for moving the pouring ladle in the back and forth directions and the control system Gz for moving the pouring ladle in the vertical direction. Thus, a method is realized wherein by the method the lip 10*a* of the ladle 10 is caused to advance to the sprue 20*a* of the mold 20 and the molten metal is caused to be accurately poured into the sprue of the mold without the pouring ladle 10 striking the mold 20 or a pedestal 14 or other objects.

The pouring control method of the invention of this application is applied to a program for controlling the pouring of molten metal that can cause the computer to carry out the method. The method is also applied to a storage medium that is readable by a computer and in which the program is stored. Namely, the program causes the computer to carry out pouring control processes for an automatic pouring device with a tilting-type pouring ladle. The device can control the movement of the ladle in the back and forth and up and down directions, and can also control its tilting. The processes comprise setting a target flow rate of molten metal to be poured, generating a voltage to be input to a tilting motor so as to reach the target flow rate of the molten metal based on an inverse model of a mathematical model of molten metal that runs out of a pouring ladle and based on an inverse model of the tilting motor, estimating the flow rate of the molten metal that runs out of the ladle, estimating the falling position of the molten metal and getting the falling position to be a target position, and generating a trajectory for the movement of the pouring ladle wherein the trajectory causes the height of the lip of the pouring ladle above the level of a sprue of a mold to decrease and causes the ladle not to strike any object located within the range of its movement.

(Example of Modification)

In addition to a feed forward control, a feedback control can correct an error of a falling position of molten metal and can accurately control the position. For example, a video camera is placed by a side of the automatic pouring device with a tilting-type ladle 1. The falling position of the molten metal that runs out of the lip 10*a* of a pouring ladle 10 is determined by the camera. A target position is defined in a coordinate system around the camera. The difference between the target position and the falling position is determined. At the block for generating a trajectory for the movement of a pouring ladle $D_{yz}$, a feedback control is carried out so as to eliminate the difference. Then the pouring ladle 10 is moved. By this control, even if the estimation of the falling position has an error, since the error is minimized by the feedback control, the falling position can be accurately controlled.

Effects of the First Embodiment

By the pouring control method of the invention of this application, since a falling position of molten metal is controlled, the molten metal that runs out of the ladle 10 can be accurately poured into the sprue 20*a* of a mold. Namely, a trajectory for the movement of the pouring ladle is generated so that the trajectory causes the ladle not to strike any object located within the range of its movement and so that the height of the lip 10*a* of the pouring ladle 10 above the level of the sprue 20*a* of the mold decreases. Based on the trajectory, the movement of the pouring ladle is controlled and the molten metal is poured into the mold 20. Thus the free-fall time of the molten metal poured from the pouring ladle 10 can be shortened, compared to that of a conventional pouring control method in which no lip 10*a* of a pouring ladle 10 is controlled to have it approach a sprue 20*a* of a mold. Also, any decrease in the temperature of the molten metal can be restricted. Further, the velocity of the molten metal when the metal reaches the mold 20 can be lowered, and so scattering of the metal can be restricted.

Also, the invention of this application can be applied to a program for controlling the pouring of molten metal, which program can cause the computer to carry out the method. This invention is also applicable to a storage medium that is readable by a computer and in which the program is stored.

Second Embodiment

By the first embodiment, the movement of the pouring ladle 10 is controlled so that the height of its lip 10*a* above the level of the sprue 20*a* of the mold decreases. By the second embodiment, a trajectory is generated based on the striking mode, which mode exists between the pouring ladle 10 and the object located within the range of the movement of the ladle 10, and is previously set. The trajectory is generated so that the height of the lip 10*a* of the pouring ladle 10 above the level of a sprue 20*a* of the mold is minimized. When the molten metal is being poured, the pouring ladle 10 is moved so that it is tilted around a hypothetical axis set on the lip 10*a* without its height being changed.

By the first embodiment, a trajectory of the movement of a pouring ladle 10 is generated so that the height of the lip 10*a* of the pouring ladle 10 is minimized, under the dynamic condition in which the height of the lip 10*a* is varied when molten metal is being poured. By the second embodiment, under a static condition, a height of the pouring ladle 10 that does not cause the ladle 10 to strike any object around it and a trajectory of the movement of the pouring ladle 10 are determined. Then an initial position from which molten metal is poured is determined.

The steps for determining an initial position of a pouring ladle 10 from which the lip 10*a* of the pouring ladle 10 starts to approach the sprue 20*a* of the mold are as follows. First, the input voltage u[V] to a servomotor and the angle θ [deg] of the tilting of the pouring ladle are determined for a target flow rate $q_{ref}$ of the molten metal to be poured, by using the equations (20)-(22). By assigning the determined input voltage u[V] and the angle θ [deg] of the tilting to equations (10)-(18), a relative falling position $S_v$ [m], which is the horizontal distance between the position and the end of the lip 10*a*, is decided. Then a mode value $M_o$ ($S_v$) of the relative falling position $S_v$ [m] is obtained. By assigning these values to the elements of the trajectory of the movement of the pouring ladle, which elements are shown in equations (23)-(34), the initial position of the pouring ladle at the beginning of pouring molten metal is derived (corresponding to the step for generating a second trajectory for the movement of the pouring ladle in claim 3). When the molten metal is being poured, the pouring ladle 10 is tilted by turning the ladle around the hypothetical axis set at the end of the lip 10*a*. Therefore, since the ladle 10 will be retracted from the mold 20 and the pedestal 14 compared to the initial position of the ladle, there will be no possibility of striking either one. Accordingly, by using a simple control, the lip 10*a* of the pouring ladle 10 can advance to the sprue 20*a* of the mold 20 without striking the mold 20 or pedestal 14. Also, since the height of the lip 10*a* of the ladle is constant when the molten metal is being poured, the pouring can be less affected by an external disturbance. Also, the electric power necessary to move the pouring ladle can be less. By not assigning the mode value $M_o$ (Se) of the relative falling position $S_v$ [m], but by assigning a medium value or a mean value of the position $S_v$ [m] to the elements of the trajectory of the movement of the pouring ladle, the position of a pouring ladle at the beginning of pouring molten metal is derived.

Also, the invention of this application can be applied to a program for controlling the pouring of molten metal that can cause the computer to carry out the method. This invention is also applied to a storage medium that is readable by a computer and in which the program is stored. Namely, the program causes the computer to carry out pouring control processes for an automatic pouring device with a tilting-type pouring ladle. The device can control the movement of the ladle in the back and forth and up and down directions, and also can control its tilting. The processes comprise setting a target flow rate of molten metal to be poured, generating a voltage to be input to a tilting motor so as to reach the target flow rate of the molten metal based on an inverse model of a mathematical model of molten metal that runs out of a pouring ladle and based on an inverse model of the tilting motor, estimating the flow rate of the molten metal that runs out of the ladle, estimating the falling position of the molten metal and getting the falling position to be a target position, setting a hypothetical axis at the lip of the ladle, and generating a second trajectory for the movement of the pouring ladle wherein the trajectory causes the ladle not to strike any object located within the range of its movement and minimizes the height of the lip of the pouring ladle above the level of a sprue of a mold.

Effects of the Second Embodiment

By the pouring control method of this embodiment, since the falling position of molten metal is controlled, the molten metal that runs out of the pouring ladle 10 can be accurately poured into the sprue 20*a* of the mold. Also, a trajectory for the movement of the pouring ladle 10 is generated so that the trajectory causes the ladle 10 not to strike any object located within the range of its movement and minimizes the height of the lip 10*a* of the ladle 10 above the level of the sprue 20*a* of the mold. Based on the trajectory, the movement of the pouring ladle 10 is controlled so that the ladle turns around a hypothetical axis, which is set at the lip 10*a* of the ladle, and the molten metal is poured into the mold 20. Thus, the free-fall time of the molten metal poured from the pouring ladle 10 can be shortened, compared to that of a conventional pouring control method in which no lip 10*a* of a pouring ladle 10 is controlled to have it approach a sprue 20*a* of a mold. Also, any decrease in the temperature of the molten metal can be restricted. Further, the velocity of the molten metal when the metal reaches the sprue of the mold 20 can be lowered and scattering of the metal can be restricted. Since the height of the lip 10*a* of the ladle is constant when the molten metal is being poured, the pouring can be less affected by an external disturbance. Also, the electric power necessary to move the pouring ladle 10 can be less.

Also, the invention of this application can be applied to a program for controlling the pouring of molten metal that can cause the computer to carry out the method. This invention is also applicable to a storage medium that is readable by a computer and in which the program is stored.

EXAMPLE

To clarify the availability of the invention of this application, the trajectory generated by the present invention was compared to the trajectory generated by a conventional method. In that method no lip of a pouring ladle was controlled to have it approach a sprue of a mold. As for the initial conditions, the initial angle of the tilting was $\theta_0=20$ [deg] and the initial distance between the center of the sprue of the mold and its side was $d_m=0.25$ [m]. Also, the target flow was given by the shape of the bell in FIG. 8 and that in a part having a constant value was max $(q_{ref})=3.5\times10^{-4}$ [m3/s].

FIG. 9 shows a trajectory of a movement of a pouring ladle as a result of using a conventional method. FIG. 10 show a trajectory of a pouring ladle as a result of using the pouring control method of the invention of this application. FIG. 11 shows trajectories of the end of a lip of a pouring ladle and its bottom, of the invention of this application, compared to a conventional one. Looking at the trajectories of the end of the lip, when we used the pouring control method of the invention of this application, we found that the height of the lip corresponding to each position during its movement was lower than that of the conventional one. Compared to the conventional method, by the method of the present invention we achieved the position that was 150 [mm] lower than that achieved by the conventional one, from which the molten metal was poured. By looking at the trajectories for the movement of the bottom of the pouring ladle, we found that by the conventional method, as the process of pouring molten metal was progressing, the distance between the pouring ladle and the mold became larger. In contrast, by the method of the present invention, the pouring ladle moved near the surface of the mold. From this viewpoint, we found that we achieved a position lower than that achieved by the conventional one, from which the molten metal was poured. Further, we ascertained that no contact between the ladle and the mold would occur, because the trajectory of the bottom of the ladle went along the upper and side surfaces of the mold.

LIST OF REFERENCE SIGNS

1 an automatic pouring device with a tilting-type ladle
10 a pouring ladle
10*a* a lip of the pouring ladle
10*b* a guide of the lip
10*c* a lateral side of a front part of the pouring ladle
11, 12, 13 servomotors
14 a pedestal
20 a mold
20*a* a sprue of the mold

The invention claimed is:

1. A pouring control method for an automatic pouring device with a pouring ladle, wherein the device can control movements of the ladle in back and forth and up and down directions, and can also control its tilting, wherein the method comprises: setting a target flow rate of molten metal to be poured, applying a voltage input to a tilting motor so as to reach the target flow rate of the molten metal based on an inverse model of a mathematical model of molten metal that runs out of a pouring ladle and an inverse model of the tilting motor, estimating a flow rate of the molten metal that runs out of the ladle, and estimating a falling position and getting the estimated falling position to be a target position, and generating a trajectory for movement of the pouring ladle wherein the trajectory causes a height of a lip of the pouring ladle above a level of a sprue of a mold to decrease and causes the ladle not to strike any object located within a range of its movement, wherein the method controls the movement of the pouring ladle to pour the molten metal into the mold so that the height of the lip of the pouring ladle above the level of the sprue of the mold decreases and so that the ladle does not strike any object when the molten metal is being poured into the mold.

2. A pouring control method of claim 1, wherein the trajectory for the movement of the pouring ladle is generated based on a mode in which the pouring ladle is going to strike the object (hereafter, the striking mode), which mode is previously set, and based on the conditions for changing the movement of the ladle, which conditions are decided based on the striking mode.

3. A pouring control method for an automatic pouring device with a pouring ladle, wherein the device can control movements of the ladle in back and forth and up and down directions, and can also control its tilting, wherein the method comprises: setting a target flow rate of molten metal to be poured, applying a voltage input to a tilting motor so as to reach the target flow rate of the molten metal based on an inverse model of a mathematical model of the molten metal that runs out of a pouring ladle and an inverse model of the tilting motor that tilts the ladle, estimating a flow rate of the molten metal that runs out of the ladle, and estimating a falling position of the molten metal and getting the estimated falling position to be a target position, setting a hypothetical axis at a lip of the ladle, generating a first trajectory for the movement of the pouring ladle wherein the trajectory causes the ladle not to strike any object located within the range of its movement and minimizes a height of the lip of the pouring ladle above a level of a sprue of a mold, wherein the method controls the movement of the pouring ladle so that the ladle does not strike any object when the molten metal is being poured into the mold, and so that the ladle pours the molten metal into the mold by turning the ladle around the hypothetical axis set at the lip of the ladle.

4. A pouring control method of claim 3, wherein at a step of generating the first trajectory for the movement of the pouring ladle the first trajectory determines a location of the ladle based on a striking mode in which the pouring ladle is going to strike the object, and which mode is previously set.

* * * * *